US011375817B2

(12) United States Patent
Hutchinson, Jr. et al.

(10) Patent No.: US 11,375,817 B2
(45) Date of Patent: Jul. 5, 2022

(54) APPARATUS AND METHODS FOR THE UNDERSTRUCTURE OF A CHAIR BASE

(71) Applicant: Medway Plastics Corporation, Long Beach, CA (US)

(72) Inventors: Thomas A. Hutchinson, Jr., Coto De Caza, CA (US); Gerald A. Hutchinson, Austin, TX (US); Richard E. Hutchinson, Lakewood, CA (US)

(73) Assignee: Medway Plastics Corporation, Long Beach, CA (US)

( * ) Notice: Subject to any disclaimer, the term of this patent is extended or adjusted under 35 U.S.C. 154(b) by 146 days.

(21) Appl. No.: 16/838,881

(22) Filed: Apr. 2, 2020

(65) Prior Publication Data

US 2020/0315353 A1 Oct. 8, 2020

Related U.S. Application Data

(60) Provisional application No. 62/829,348, filed on Apr. 4, 2019.

(51) Int. Cl.
*A47C 7/00* (2006.01)

(52) U.S. Cl.
CPC ..... *A47C 7/004* (2013.01); *A47C 7/006* (2013.01)

(58) Field of Classification Search
CPC ..... A47C 7/004; A47C 7/006
USPC ..... 248/188.1, 188.7, 188.8
See application file for complete search history.

(56) References Cited

U.S. PATENT DOCUMENTS 298,014 A * 5/1884 Monk ..... B26B 17/00 301/83
5,149,035 A * 9/1992 Bonnema ..... A47C 5/12 248/188.7
5,402,973 A * 4/1995 Haines ..... A47C 7/004 248/188.7
D458,776 S 6/2002 Patton
6,669,292 B2 12/2003 Koepke et al.
2012/0080572 A1* 4/2012 Lin ..... A47C 7/004 248/188.7

(Continued)

FOREIGN PATENT DOCUMENTS

CN 2326077 Y * 6/1999 ..... A47C 7/004
CN 2385601 Y * 7/2000 ..... A47C 7/006
CN 2410925 Y * 12/2000 ..... A47C 7/004

(Continued)

OTHER PUBLICATIONS

International Search Report and Written Opinion dated Jun. 25, 2020 for Application No. PCT/US20/26267, 16 pages.

*Primary Examiner* — Kimberly T Wood
(74) *Attorney, Agent, or Firm* — Knobbe, Martens, Olson & Bear, LLP

(57) ABSTRACT

The embodiments relate to a geometric under structure, central and outer hub for a GFN plastic chair base. The geometric shape and dimensions are critical components to the overall strength of the chair base hub and arms when either vertical or rotational forces are applied at the central hub. The central hub is of sufficient thickness to maintain dimensional stability when the forces are applied. The overall geometry and material composition enable the hub area to be constructed with minimal plastic wall thickness while optimizing the physical strength of the article and facilitating high production rate.

20 Claims, 15 Drawing Sheets

(56) References Cited

U.S. PATENT DOCUMENTS

| | | | | |
|---|---|---|---|---|
| 2013/0062495 | A1* | 3/2013 | Lin | A47C 7/004 248/440.1 |
| 2018/0134506 | A1 | 5/2018 | Hutchinson et al. | |

FOREIGN PATENT DOCUMENTS

| | | | | | |
|---|---|---|---|---|---|
| CN | 201709839 | U | * | 1/2011 | A47C 7/004 |
| CN | 203073783 | U | * | 7/2013 | A47C 7/004 |
| CN | 203897802 | U | * | 10/2014 | A47C 7/004 |
| DE | 29711937 | U1 | * | 9/1997 | A47C 7/004 |
| EP | 0357578 | A1 | * | 3/1990 | A47C 5/12 |
| GB | 2324266 | A | * | 10/1998 | A47C 7/004 |
| JP | 2015119863 | A | * | 7/2015 | A47C 7/006 |
| KR | 920005138 | Y1 | * | 7/1992 | |
| KR | 950006210 | Y1 | * | 8/1995 | |
| KR | 101774689 | B1 | * | 9/2017 | A47C 7/004 |
| TW | M 313467 | U | | 6/2007 | |
| WO | WO-9011709 | A1 | * | 10/1990 | A47C 7/004 |
| WO | WO-2014205125 | A1 | * | 12/2014 | A47C 4/02 |

* cited by examiner

APPARATUS AND METHODS FOR THE UNDERSTRUCTURE OF A CHAIR BASE

PRIORITY, CROSS-REFERENCE, AND INCORPORATION

This application claims priority under 35 U.S.C. § 119 to U.S. Provisional Patent Application No. 62/829,348 filed Apr. 4, 2019, titled, "APPARATUS AND METHODS FOR THE UNDERSTRUCTURE OF A CHAIR BASE". The entire contents of the above is hereby incorporated into this document by reference and made a part of this specification for all purposes, for all that it contains. Moreover, any and all applications for which a foreign or domestic priority claim is identified in the Application Data Sheet of the present application are hereby incorporated by reference under 37 C.F.R. § 1.57.

BACKGROUND

Field

The disclosure generally relates to features on a chair base.

Related Art

A chair base can include a structure which supports a chair, typically an office chair mounted on wheels, so that the chair can roll around the user's desk area.

SUMMARY

For purposes of this summary, certain aspects, advantages, and novel features of the embodiments are described herein. It is to be understood that not necessarily all such advantages may be achieved in accordance with any particular embodiment of the embodiments. Thus, for example, those skilled in the art will recognize that the embodiments may be embodied or carried out in a manner that achieves one advantage or group of advantages as taught herein without necessarily achieving other advantages as may be taught or suggested herein.

In general, vertical forces are compressive in that the weight of the user presses down upon the shaft of the chair which is inserted into the central hub. The rotational forces are applied about an axis represented by that shaft and occur, generally, as friction and other vectors are applied on the arms of the chair base. These experiments produced a surprising result in that the concentration of force is focused between the arms and are not evenly distributed throughout the diameter, nor are they focused predominantly at the arms where they connect to the hub.

Advantageously, the experiments have shown the article of these embodiments result in outstanding vertical and torsional strength of the arm to hub relationship utilizing less material and wall thickness. One of the functional and structural advantages of the embodiments is the concentration of strength where the forces exerted on the chair base under normal circumstances are concentrated; namely, at the central point on the outer hub between the arms, rather than a placement central to the arms where one might assume. It should be noted that, throughout this disclosure, "arm" and "leg" may be used interchangeably to refer to the appendage on which the roller/casters are mounted on a chair base of this type.

This placement of structural strengthening elements between the arms yields a surprisingly strong understructure for the chair base. Because of this advantage and other related advantages, understructure coring can be increased and wall thicknesses can be decreased in certain locations. These ancillary advantages reduce cost by reducing material usage, enhance cooling in the injection molding process, and improve tooling longevity.

Some embodiments can include a chair base comprising an understructure and a top, the chair base further comprising: a central opening configured to receive a shaft of a swivel chair; a plurality of arms each configured to accept a caster stem; a hub surrounding the central opening and connected to the plurality of arms, the arms generally extending radially therefrom in an evenly spaced manner; a hoop structure encircling the hub and comprising: a plurality of hoop ribs spaced evenly around the circumference of the hub and supporting an outer wall thereof, each hoop rib extending along a radius aligned with a gap between two adjacent arms; a hoop wall to which the hoop ribs connect and from which the plurality of arms extends; and a plurality of hoop cores comprising voids surrounded by adjacent hoop ribs, a portion of the hoop wall, and a portion of an outer wall of the hub, each hoop core generally aligned radially with one of the plurality of arms.

In some embodiments, each arm includes at least one arm rib, wherein the arm rib is X-shaped.

In some embodiments, the arm rib is disposed on the understructure of the chair base and not on the top of the chair base, wherein the top of the chair base is facing the swivel chair.

In some embodiments, a portion of the arm rib is tapered via a variable radii at an intersection point between the arm rib and the side of the arm.

In some embodiments, each arm further includes at least one arm core comprising a void.

In some embodiments, the arm core is adjacent to the arm rib and the hoop structure.

In some embodiments, the arm core includes a triangle shape 113 adjacent to the arm rib, and an extension shape 115 from the hoop structure.

In some embodiments, the hoop rib is disposed on the understructure of the chair base and not on the top of the chair base.

In some embodiments, the hoop rib comprises a curved portion between two adjacent arms with a radii between 70 to 90 degrees of curvature.

In some embodiments, the hoop core is disposed on the understructure of the chair base and not on the top of the chair base.

In some embodiments, the hoop core is of generally oval shape.

In some embodiments, a width of the hoop core is substantially the same width of the corresponding arm.

Some embodiments can include a chair base comprising: a plurality of arms each configured to accept a caster stem; a hub surrounding the central opening and connected to the plurality of arms, the arms generally extending radially therefrom in an evenly spaced manner; a hoop structure encircling the hub and comprising: a plurality of hoop ribs spaced evenly around the circumference of the hub and supporting an outer wall thereof, each hoop rib extending along a radius aligned with a gap between two adjacent arms; and a plurality of hoop cores comprising voids surrounded by adjacent hoop ribs and a portion of an outer wall of the hub, each hoop core generally aligned radially with one of the plurality of arms.

In some embodiments, each arm includes at least one arm rib, wherein the arm rib is X-shaped.

In some embodiments, a portion of the arm rib is tapered via a variable radii at an intersection point between the arm rib and the side of the arm.

In some embodiments, the hoop rib is disposed on the understructure of the chair base and not on the top of the chair base.

In some embodiments, the hoop rib comprises a curved portion between two adjacent arms with a radii between 70 to 90 degrees of curvature.

In some embodiments, the hoop core is disposed on the understructure of the chair base and not on the top of the chair base.

In some embodiments, the hoop core is of generally oval shape.

In some embodiments, a width of the hoop core is substantially the same width of the corresponding arm.

Some embodiments can include a plastic chair base constructed of uniform geometrical modules comprising 3 to 8 arms wherein the outer hub is reinforced and contains a single rib between the arms.

In some embodiments, the under structure is reinforced by a rib located between each arm. Said rib is of sufficient thickness to meet specific vertical and rotational force requirements.

In some embodiments, the arm extends from the central hub to the caster socket with a rib. Said missing rib creates a void extending to the outer shell wall thickness.

In some embodiments, the number of cores immediately adjacent to the central hub are in line and the same for each arm.

In some embodiments, there is a "variable radii" extending from the bottom of the arm wall to the inner portion of the outer shell. Such variable radii improves strength and minimizes sink/shadowing of the rib understructure on the "A" surface of the chair base.

In some embodiments, the first core within the arm creates the outer ring wall thickness along with the shell sidewall and top surface. Said core has generous radii which prevents notch development.

In some embodiments, there is no reinforcement rib in line with the arm at the center hub.

In some embodiments, the chair base is produced with between 25 and 35% GFN 6.

In some embodiments, the chair based is produced with Post-industrial recycled GFN 6.

In some embodiments, the chair base is produced with Post-consumer recycled GFN 6.

In some embodiments, the chair base is produced with between 25 and 35% GFPP.

In some embodiments, the mold cavity encapsulates electric heaters and a closed loop temperature control system.

Some embodiments can include an under structure for a chair base with a core located outside the central hub in line with each arm. Said core is molded with high heat transfer metal.

In some embodiments, the increased core dimensions provide a more robust tool for production.

In some embodiments, the increased core dimensions provide more efficient cooling and increased productivity.

In some embodiments, the core which molds the central hub is cooled by CO2.

In some embodiments, CO2 is circulated at the base of the high heat transfer core resulting in decreased cycle time and high productivity.

In some embodiments, the arm mold inserts are cooled by CO2.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements. Not all of the elements of the drawings are in to scale relate to other drawings and the comparative size of one element relative to another element in the drawings is not necessarily indicative of the relative sizes of the elements in one or more embodiments.

FIG. 10B is an exemplary illustration of the hoop core that can include a bottom portion and a top portion according to some embodiments.

FIG. 10D further illustrates tapering of arm-rib to side-wall core according to some embodiments.

FIG. 10E illustrates stress distribution of stress coming from the side of an arm according to some embodiments. FIG. 10F illustrates stress distribution of stress coming from the top of the chair base over an arm, according to some embodiments.

DETAILED DESCRIPTION

Figure 1A:
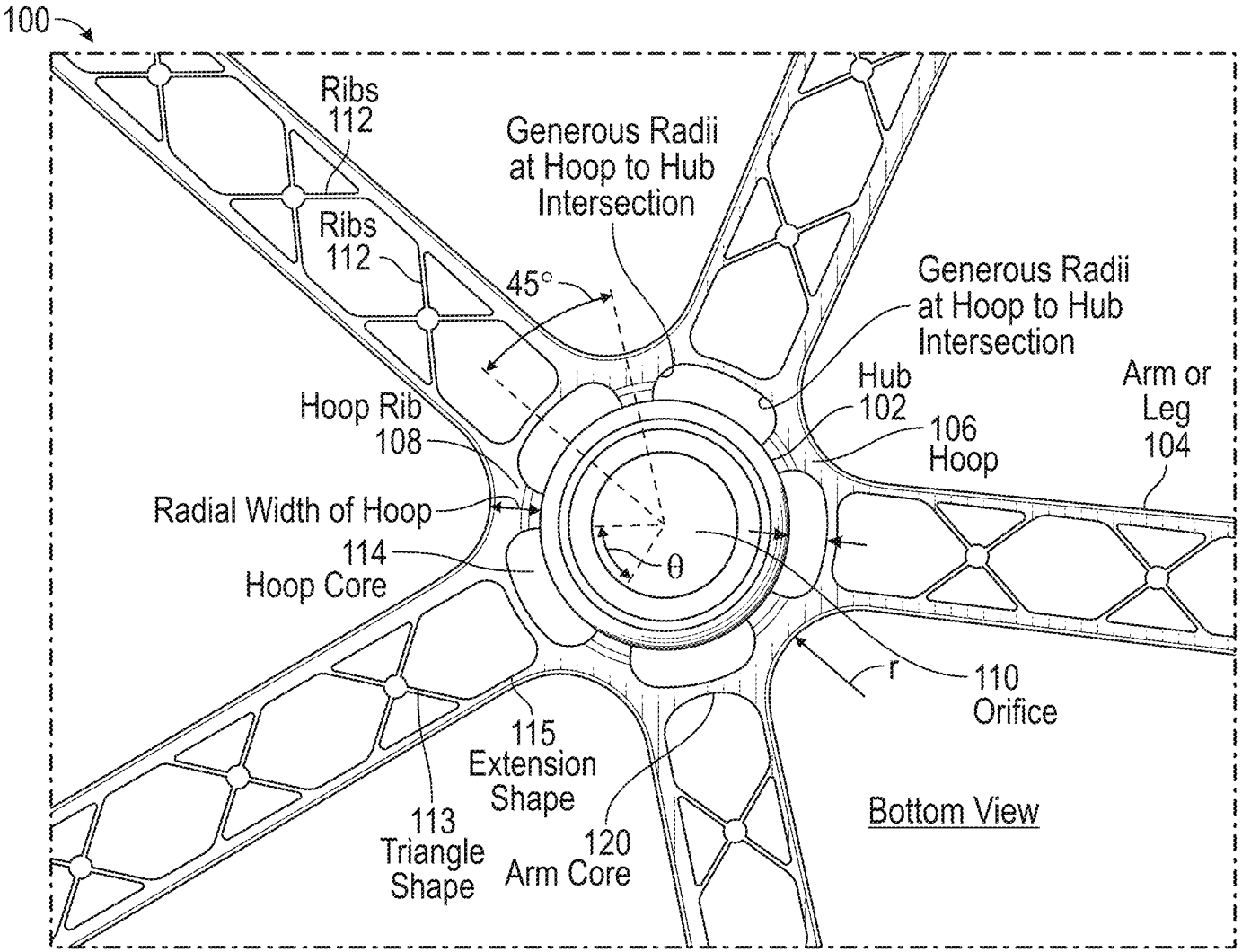
FIG. 1A shows a plan view of the understructure according to some embodiments of a chair base described herein. This understructure can be also referred to as the "bottom" of the chair base.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Elements that are described as "connected," "engaged," "attached," or similarly described, shall include being directly and/or indirectly connected, engaged, attached, etc. Alterations and further modifications of the inventive features illustrated herein, and additional applications of the principles of the inventions as illustrated herein, which would occur to one skilled in the art and having possession of this disclosure, are to be considered within the scope of the invention.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description" one will understand how illustrated features serve to explain certain principles of the present disclosure.

Example Chair Base

A chair base can include a structure which supports a chair, typically an office chair mounted on wheels, so that the chair can roll around the user's desk area. The wheels can be mounted on the ends of a plurality of arms which extend out—in a spoke-like manner—from a central hub of the chair base. A chair base can have a hub and several arms, for example.

FIG. 1A illustrates one embodiment of a chair base 100. The chair base can include a hub 102 and an arm configuration or structure for the chair base 100. In this figure, the chair base 100 comprises a hub 102 and a plurality of arms 104. Portions of the hub 102 may be generally cylindrical or frustoconical shaped. The center of the hub 102 may comprise an orifice 110 in order to accept other portions of the chair assembly; or, the hub 102 may comprise other structures. A plurality of arms 104 may extend from the hub 102. The arms 104 may extend radially and to some degree in a downward direction. The outward ends of the arms 104 may be configured to accept a foot or a caster that will eventually rest on the ground once the chair is more fully assembled.

In some embodiments, the hub 102 may be several inches in diameter and several inches in height. The hub 102 may include an outside diameter and an inside diameter. In some embodiments, the outside diameter of the hub 102 is between 1 and 8 inches; in some embodiments, the outside diameter of the hub 102 is between approximately 3 and 4 inches. In some embodiments, the height of the hub 102 is between approximately 2 and 8 inches. The arms 104 may be several inches long and may be long enough to adequately support a user once the chair is more fully assembled. The chair base 100 may be made from plastic, metal, or other generally durable material. The base 100 may be formed by various manufacturing means, including injection molding, casting, machining, press-fitting, etc. The hub 102 and arms 104 may be integrally formed, or may be made separately and later assembled.

In FIG. 1A, the arms 104 are coupled to the hub 102 by a hoop (or hoop structure) 106. The hoop 106 can include a ring-like structure surrounding the hub. The chair base 100 can include a plurality of hoop ribs 108. The plurality of hoop ribs 108 can be located around the circumference of the hub 102. These hoop ribs 108 can tie the arms 104 to the structure of the central and/or outer hub 102.

Although the "arms" of the chair base are referred to herein as arms, it is understood that they can be referred to as "legs" of the chair base. It is understood that the principles and features described herein for the arms could be applied to the legs or structures of similar shape and dimension, and vice versa.

FIG. 1A shows a plan view of the understructure of certain embodiments of a chair base 100 described herein. This is the understructure because, in normal use, the chair base is inverted. Thus, one or more arms of the chair base can comprise of an upper or top portion, or shell.

Figure 1B:
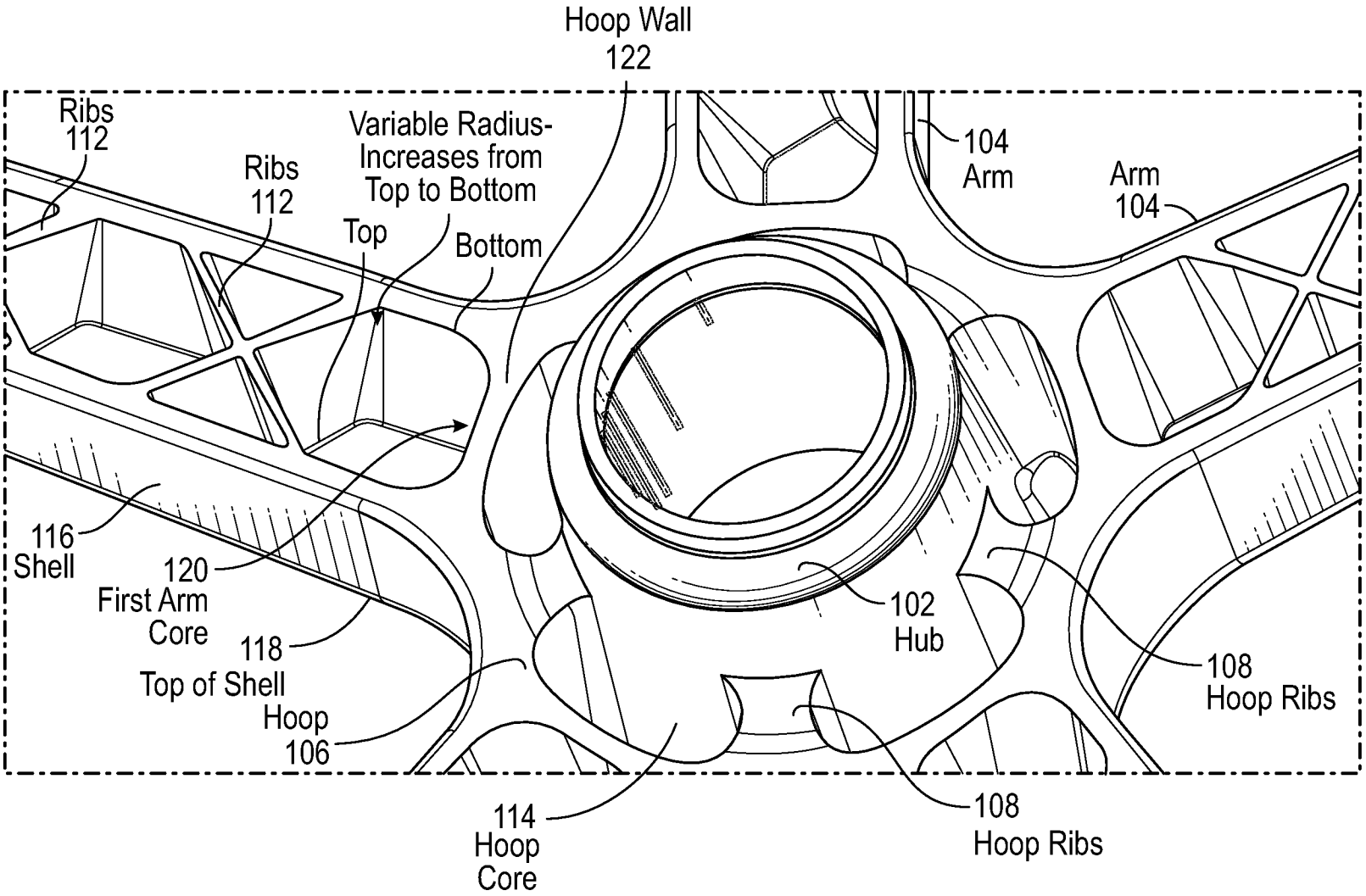
FIG. 1B shows a perspective, partially cut-away view of the central portion of the chair base of FIG. 1 illustrating the hub, the hoop surrounding the hub, and the arms/legs extending radially from the hub. This view partially illustrates the shell of the chair base which is the upper or "top" portion of the arm structures.

In some embodiments, one or more arms of the chair base can comprise arm ribs 112. The arm ribs 112 can be of an X shape as shown in FIGS. 1A and 1B. The arm ribs 112 can provide strength and/or support.

The perspective view of FIG. 1B illustrates the hub 102, hoop 106, and extending arms 104 according to some embodiments. The hoop 106 can comprise of a ring structure. The hoop 16 can include hoop ribs 108. The hoop ribs 108 can intersect with the hub 102 and hoop cores 114 which are formed in molding by the absence of material and are interspaced between hoop ribs 108.

Figure 8:
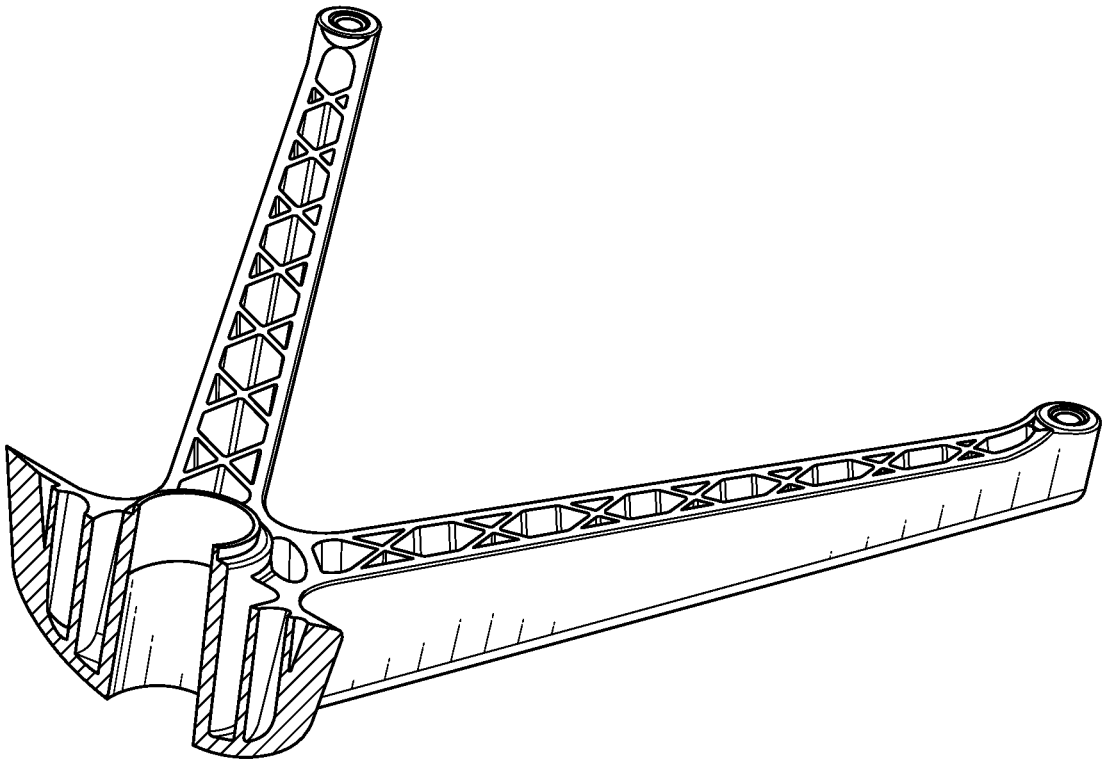
FIG. 8 is a partial cross section and perspective view of the chair base hub and two of the five arms according to some embodiments.
Figure 9:
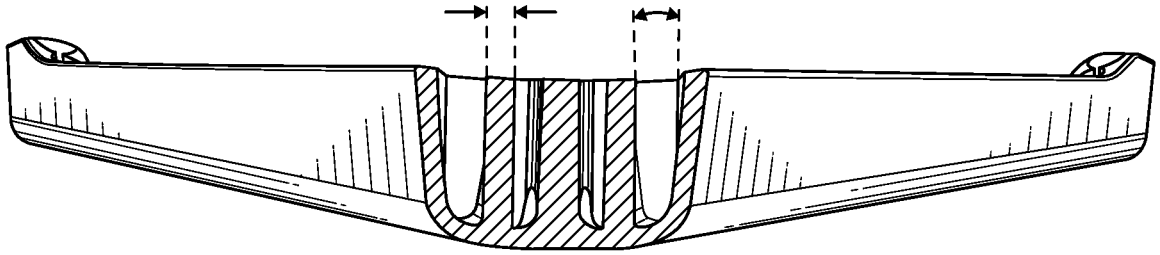
FIG. 9 is a side view of the partial cross section of FIG. 8 according to some embodiments.

In some embodiments, the shell 116 of each arm 104 can be generally U-shaped, as illustrated in FIGS. 1A, 2B, 8, and 9. FIGS. 8 and 9 also illustrate a complete arm 104 together with an arm end portion having receptacles to receive the casters for the roller chair according to some embodiments. Therefore, for purposes of this description, directional references such as "above," "upper," "below," or "lower" will refer to the chair base as shown oriented in the Figures rather than its orientation in actual use.

FIG. 1A illustrates the hub 102 and the five extending arms 104. As noted above, each arm 104 can comprise an elongate structure comprising a shell 116 and an interior X-shaped arm rib 112 or truss structure to provide strength and rigidity. The hub 102 portion can comprise of two parts, namely, the central or inner portion of the hub 102 and the outer portion or hoop 106 which is coupled to or integral with the arms 104. The central hub 102 can include a cylindrical receptacle for receiving the adjustable air piston which comprises the shaft of an office chair or roller chair of the type which is compatible with the various embodiments of the present chair base. However, it will be understood that the features and principles described herein with respect to the under structure of a chair base are equally applicable to other types of chairs and seating apparatus.

In some embodiments, with respect to the hub 102, the cylindrical central hub 102 can extend slightly above the outer hub or hoop as illustrated in FIG. 1B. The central hub has a small circumferential rim which extends around its upper most region has shown in FIG. 1B. The outer hoop portion of the hub serves as a connection for the arms of the chair base. In this regard, advantageously, the present design and construction of the chair base represents an optimal trade-off between strength and material usage. That is, the present structure maintains and even improves the strength of the chair base compared to previous designs while minimizing the use of material.

In some embodiments, the chair base is constructed from a plastic injection molding process which is relatively well understood by those skilled in the art. One material used in the molding process is GFN. However, it will be understood that the features and principles described herein apply equally to other types of material or other modes of manufacture. The arms are shown integrally molded with the hoop and hub sections; however, other forms of attachment are within the scope of the current embodiments.

In injection molding techniques, where there is an absence of material due to the presence of the mold, the hollow space or opening may be referred to as a "core." Thus, the coring of the present structure enables the optimal reduction of material in order to reduce manufacturing cost, while preserving strength. The coring of the present chair base is substantially increased as explained below in more detail. Advantageously, the coring of the present embodiments also provides for better cooling of the part during molding and upon ejection from the injection molding apparatus, as well as less metal fatigue of the tooling material.

An example of a hoop core 114 is shown in FIG. 1A adjacent the hoop 106 and aligned with each arm 104. This example hoop core 114, located immediately adjacent the hoop 106, can be referred to as the primary or main hoop core. Five such cores 106 are illustrated in FIG. 1A located radially and outwardly from the hoop 106. Each of these hoop cores 114 can be generally oval shaped, semi-oval shaped, circle shaped, or other shapes. The size and placement of these hoop cores 114 represents a significant improvement over prior under structures. Each hoop core 114 can be about the same circumferential length as the width of an arm at the hoop 106 attachment location.

In some embodiments, the hoop 106 is attached to the central hub 102 primarily by means of five hoop ribs 108 as shown in FIGS. 1A and 1B. These hoop ribs 108 can separate and can be partially formed by adjacent hoop cores 114. Again, the dimensions and placement of these hub ribs 118 can substantially improve the strength of the present chair base embodiments. These ribs 118 can be formed by radii which simultaneously provide for the hoop core dimensions, such as 60, 70, 80, 90, 100, 110, or 120 degrees of curve.

In some embodiments, each hoop rib 108 is advantageously placed between adjacent arms 104, as shown particularly in FIG. 1A. The hoop ribs 108 extend radially away from the hub 102 to form the hoop 106 or outer ring. The midpoint of each hoop rib 108 extends radially between a pair of arms and forms an arm-to-arm connection point, shown in FIG. 1A. This connection point can be about 45 degrees (or 30, 35, 40, 45, 50, 55, or 60 degrees) from the midline of the arm.

In some embodiments, throughout the hub 102/hoop 106 region, filleted edges or corners can be provided to relieve stress and preserve strength. This is particularly exemplified in the hoop core 114 and midline hoop structure as described above and illustrated by FIGS. 1A and 1B. Extending radially from the hub 102 through the midpoint of each hoop core 114 there is shown a portion of the hoop wall 122 which is relatively thinner. Advantageously, because of the strength provided by the hoop ribs 108 and midline arm connection sections of the hoop 106, the wall 122 thickness of this portion of the hoop wall can be reduced in order to decrease material usage.

In some embodiments, with further reference to FIG. 1B, the variable radii at the X-shaped arm rib 112-to-shell 116 intersections can allow for better structure structural strength without visual consequences on the outer surface. It has been discovered that the greatest stress is applied near the bottom of the arm 104 and in the hub 102/hoop 106 regions. Advantageously, the X-shaped arm ribs 112 serve to greatly strengthen the arms 104 while minimizing material usage. In addition, variable radii at the arm rib 112 to shell 116 intersection also enhance the strength of the arms 104. These radii increase as the intersection is traversed from the upper or top portions of the arm 104 toward the bottom. Thus, more material is concentrated near the bottom, as shown by the wider fillet. This effect is also shown in the cross-section of FIGS. 8 and 9.

In some embodiments, all of the hoop cores 114 of the under structure can taper slightly in the downward direction; that is, from top to bottom. This taper increases wall thickness in the downward direction toward the bottom of the U of the U-shaped shell. This taper increases the wall thickness from a thinner wall toward the top of the under structure to a thicker wall toward the bottom of the shell 116, as shown and more detail and FIGS. 8 and 9. Advantageously, this taper can reduce material usage and provide a draft to facilitate part removal from the mold. Similar tapers can be included in all cores of the illustrated and described under structure(s) shown in the figures.

In some embodiments, extending radially outward from the reduced wall thickness of the hoop wall is the first arm core 120 of each arm 104, as shown in FIGS. 1A and 1B. This first arm core 120 exhibits a general house-like shape, shown particularly well in the bottom view of FIG. 1A, including in cross-section a square with a triangle extending radially above it. However, other shapes (e.g., more rounded, rectangular, shapes with different number of sides and at different angles) are possible as shown in the alternate embodiment of one arm in FIG. 1A. Advantageously, it is significant that this first arm core 120 can have significantly reduced material usage compared to previous designs. However, first arm cores of other dimensions and shapes are within the parameters of the present disclosure. This first arm core 120 can be generally large, in order to reduce material usage, and forms a portion of the first X-shaped arm rib 112 structure of the arm 104.

Chair Base Features and Advantages

Figure 2A:
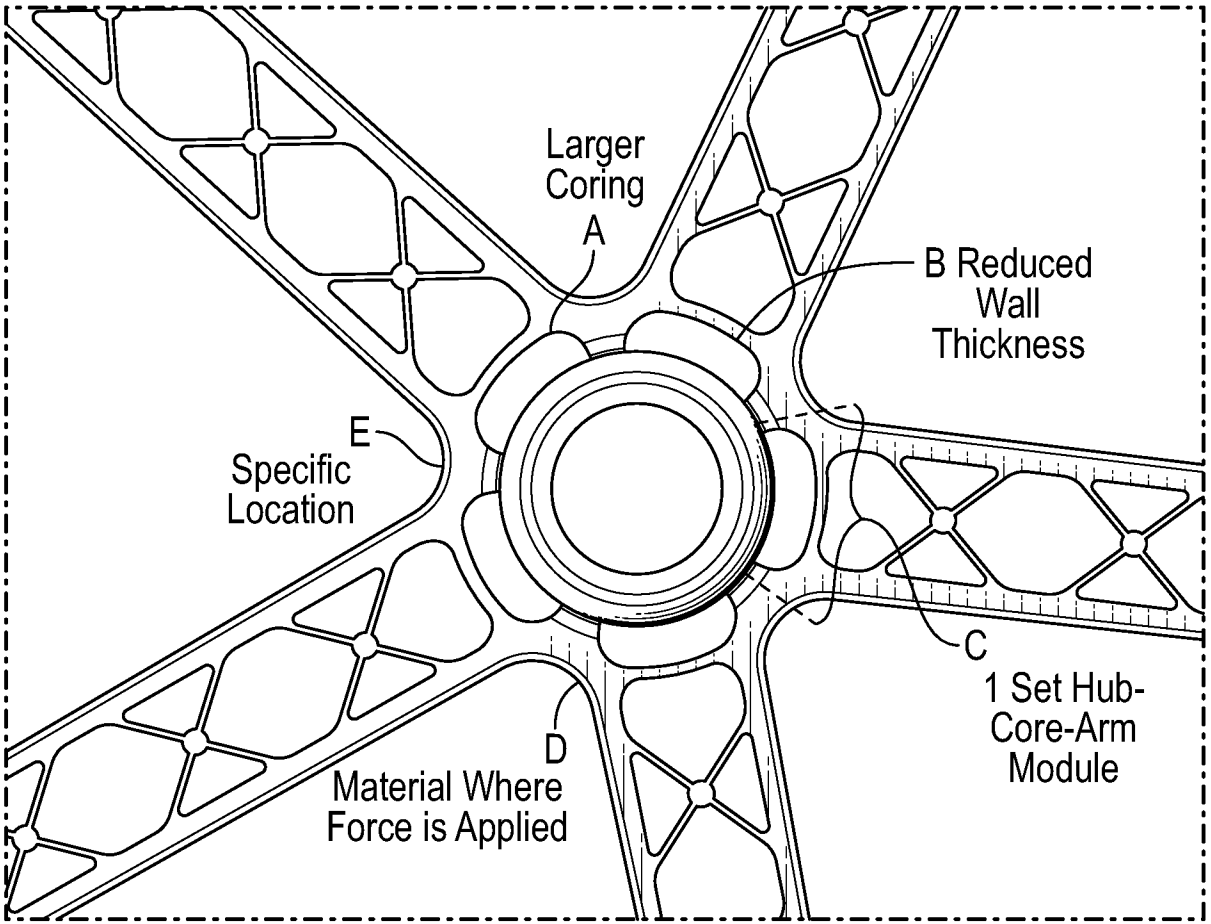
FIG. 2A shows another close up view of the bottom of the chair base according to some embodiments.
Figure 2B:
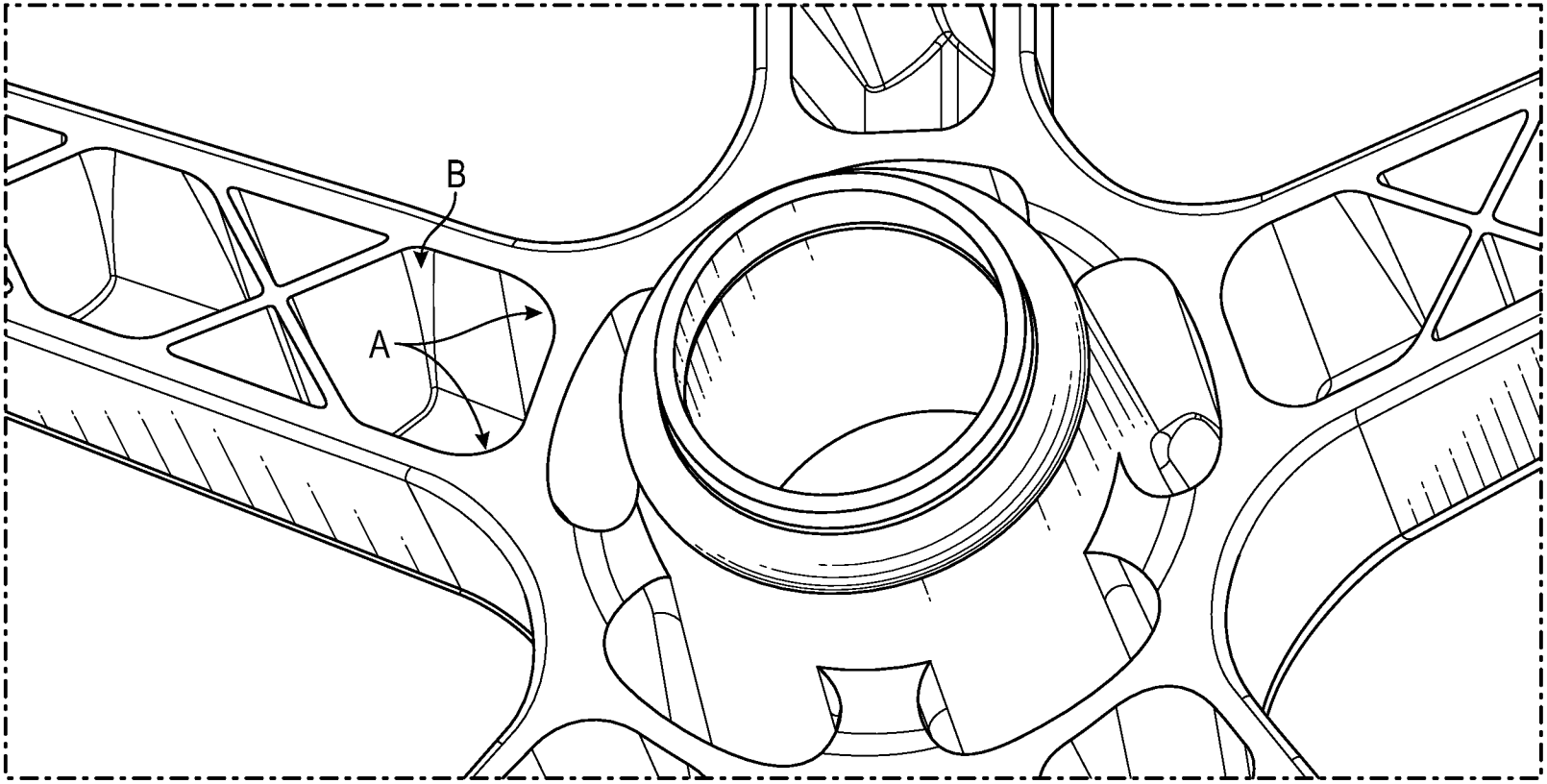
FIG. 2B is a close up perspective view according to some embodiments.

In some embodiments, the described under structures include no sharp corners or edges where stress can accumulate and result in points of failure. Advantageously, this non-sharp approach reduces material usage while preserving strength. FIG. 2A shows a GFN plastic base according to some embodiments. In this example, there are no hoop ribs central to the arms. The coring is centrally located to each arm and limited to one per arm. FIG. 2B is an illustration of an example reinforcement rib and variable radii in the hub section, according to some embodiments.

FIG. 2A, reference letter A exhibits the larger coring allowed by eliminating a central rib aligned with the center axis of an extending arm. Advantageously, the larger core can facilitate more uniform wall thickness of the inner and outer hub, resulting in better cooling characteristics and lower cycle time. In addition, the mold that can form this larger coring can provide a robust metal structure that is more resistant to cycle metal fatigue.

In this figure, reference letter B indicates the reduced wall thickness of the outer shell aligned with a central elongate axis of an arm. This feature can have advantages since the vertical and torsional forces are more concentrated between the arms, rather than along the midline of the arms.

In this figure, reference letter C indicates a grouping or set of figures comprising a hub-core-arm module. The figure shows the relationship between the inner hub, outer hub or hoop, and arm. In this illustration the base has 5 circumferentially-positioned hub-core-arm modules. Each arm can be independently connected to the hub in this manner. In some embodiments and designs, there are no physical elements shared between the discreet arms and hub assembly. However, as shown, the structure can be molded as a unit such that the hub-core-arm modules are integrally formed from continuous plastic material, for example.

In this figure, reference letter D shows a rib which is significantly reinforced between the arm modules where the forces can be focused and strength is particularly advantageous.

In this figure, reference letter E shows a specific location having corresponding increased plastic thickness and reinforcement between the arm modules. This location can correspond to a zone where two hub-core-arm modules meet, resulting in increased plastic thickness. These modules can be formed integrally rather than independently or modularly for later assembly.

FIG. 2B is a perspective view illustrating an understructure detail. In some embodiments, "variable radii" can characterize some or all intersection points. The radii can describe contours of a manufacturing mold. For example, if a given protrusion from a manufacturing mold forms a right-circular cylinder, the corresponding void (or core) in the molded material that it forms will tend to also have a right-circular cylindrical shape. However, the right-angle formed by this cylinder will tend to create a sharp corner in the molded void, where different walls of plastic join together. Moreover, if adjacent molding protrusions (which form adjacent voids) each have vertical parallel wall surfaces, the resulting wall between the resulting voids will tend to have a uniform thickness. But uniform thicknesses rea often prone to failure (given that stress is typically not uniform) and sharp corners tend to concentrate stress. Using mold protrusions with variable radii (and creating resulting plastic structures having variable radii) can tend to spread stress and distribute forces. Similarly, allowing more material to fill corners where plastic walls meet can reinforce adjoining walls. Thus, variable radii approaches can include forming protrusions with rounded or sloping edges, and allowing adjacent protrusions to have contoured (rather than straight, parallel) side walls. This approach can result in the structures illustrated in FIG. 2B, where voids or cores in the plastic material have rounded corners. This rounding can also improve the ability to remove parts from molds and reduce a failure rate due to mold removal.

Figure 3:
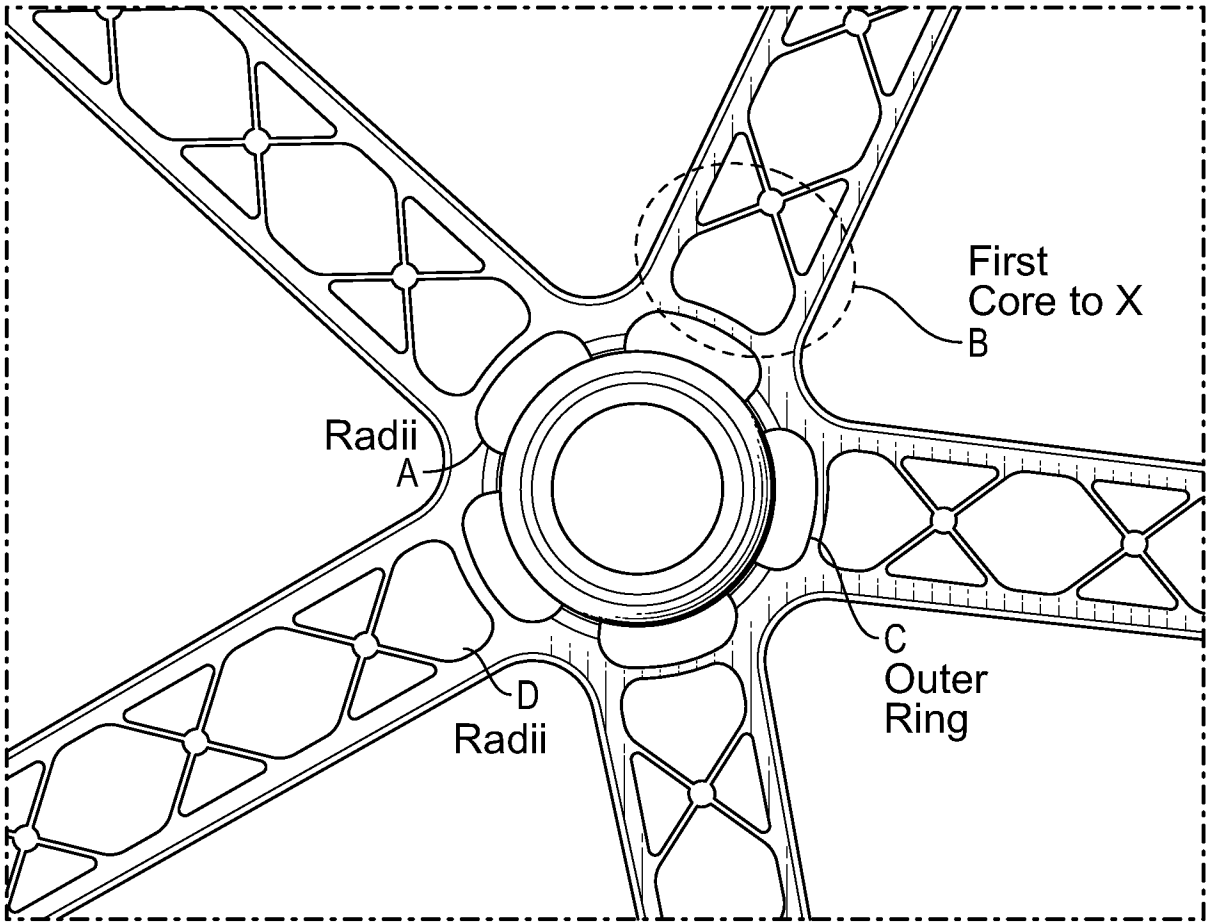
FIG. 3 is another view of the understructure of the chair base according to some embodiments.

FIG. 3 shows a base illustrating features of this disclosure. Reference letter A exhibits radii of the coring at the intersection of the middle rib. The core radii can span about 120, 130, 140, 150, 160, 170 degrees. Reference letter B exhibits the first arm core outside the outer ring of the hub. The core is of substantial size and ties the arm shell thickness to the center reinforcement. Reference letter C illustrates the outer ring around the hoop core. Reference letter D exhibits the generous and flowing radii of the first arm core. In this illustration, the radii refer to the non-uniform (non-circular) shape of the first arm core side walls.

Figure 4:
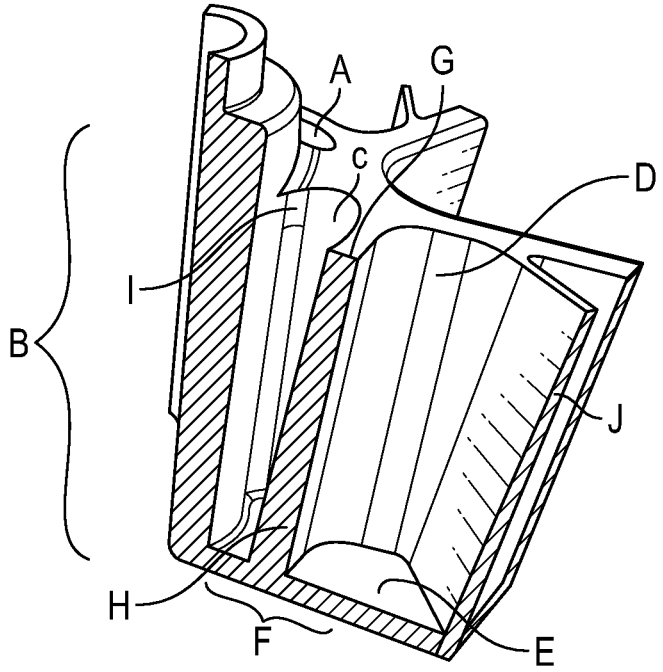
FIG. 4 is a partial cross section of the tapered coring of the ribs illustrating an embodiment of the understructure detail incorporation the variable radii at intersection points.

FIG. 4 shows a cutaway perspective view of a portion of the chair base of FIG. 3. This cut-out portion (and those shown in the views of FIGS. 5 and 6) can comprise a hub-core-arm module corresponding to label C in FIG. 2A, for example. Reference letters A and C label remaining portions of adjacent hoop cores. Between these cores is a radial wall which ties the hoop ribs between the arms into the central hub/hoop region. In some embodiments, the radii described herein can be, form or characterize walls that extend generally radially from the hub or core. Reference letter B exhibits the wall thickness of the central hub, which can be minimized by providing strategic struts of support at periodic intervals around its circumference. Reference letter D indicates the first arm core and radii. Reference letter E labels a floor (or roof) of the first arm core. Reference letter F exhibits the relatively uniform wall thickness of the arm shell.

Reference letters G and H illustrate taper of the hoop wall. At the bottom (G), the hoop wall can be thinner than at the top (H), providing better strength by distributing the stress on the bottom to the top while reducing material requirements. This tapering wall thickness provides an example of the variable radii approach, which tends to spread stress and improve strength and durability. The taper as illustrated here also helps with the injection molding manufacturing process, because protrusions of a mold can be tapered toward their extremities, reducing the force necessary for disengagement of the molded material from the mold tooling itself. Reference letter I illustrates tapering of an intersection between the hoop rib and the hub. Reference letter J illustrates tapering of the X-shaped arm ribs. Tapering described for one embodiment can be applied to other embodiments, and the advantages therein.

Cutout Views of Certain Chair Base Features

Figure 5:
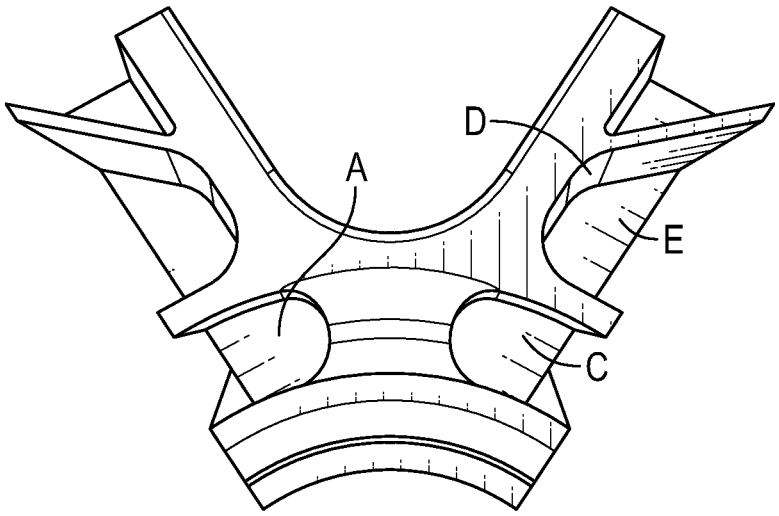
FIG. 5 shows a plan view of the cross section of FIG. 5 according to some embodiments.
Figure 6:
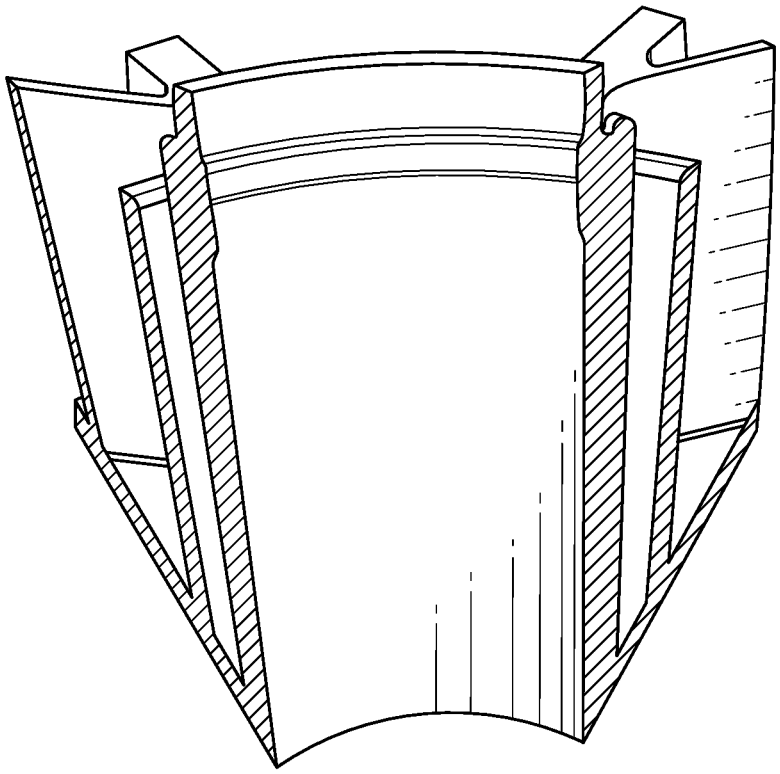
FIG. 6 shows another view of the cross section of FIG. 4 according to some embodiments.

FIG. 5 is a top view cutout generally corresponding to the excerpt shown in FIGS. 4 and 6, or a hub-core-arm module (see label B in FIG. 2A). This view helps show how the structural design elements work together to ultimately result in optimized physical properties of the article, the materials, the tooling and numerous other production benefits. References A and C label adjacent hoop cores, while reference E labels a remaining portion of a first core to X (see FIG. 3). Reference D points to a sloping wall for this core, where one of the thinner X walls joins with the thicker wall of the radial arm structure. This sloping wall can comprise variable radii, either when measured top to bottom and when measured laterally, or both.

FIG. 6 is a side view cutout of a hub-core-arm module (see FIGS. 4 and 5, and label B in FIG. 2A). This is shown from a perspective toward the central axis of the chair base.

Figure 7:
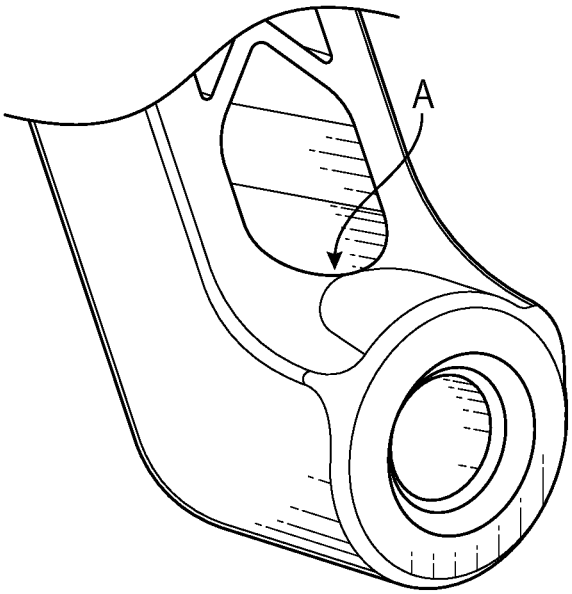
FIG. 7 is a perspective view of the end of an arm showing an insertion opening for the shaft of a caster or wheel according to some embodiments.

FIG. 7 is a perspective view of a detail of a terminal end of an arm corresponding to the insertion opening or caster socket, which receives the shaft of a caster or wheel. This design feature improves both vertical and rotational strength. This view also illustrates the last core at the end of the arm or leg showing a full rounded filleted core with enhanced strength and reduced material usage.

The cross-sectional views of FIGS. 8 and 9 illustrate the variable radii features of the X-shaped ribs and shell of the arms. In many cases the wall thickness are uniform. In other locations, where forces are concentrated, the walls are tapered to strategically distribute material in those regions. The cutaway view of FIG. 9 shows how the bottom of the hoop cores (their roofs when the chair base is in use) can be rounded, which provides strength, weight and stress distribution, and mold-removal benefits.

Advantages of Thinner, More Uniform Wall Thicknesses

In some embodiments, the present embodiments allow the chair base to exhibit thinner wall thickness in many key areas of the design. This is an important and surprising advantage when one considers the significant forces which are exerted on a chair base of the type described. Reduced wall thicknesses bring about many advantages in the injection molding process. Prior to ejection from the mold, injection molded parts are cooled down from manufacturing temperatures so that they hold their shape when ejected. During the part cooling step of the molding process, changes in pressure, velocity and plastic viscosity should be minimized to avoid defects. One of the important aspects of the present chair base embodiment is wall thickness. This feature can have major effects on the cost, production speed and quality of the final parts.

Designing the proper chair base wall thickness can have significant effects on the cost and production speed of manufacturing. While preserving the trade off with strength, the goal is to choose the thinnest wall possible. Advantageously, thinner walls use less material which reduces cost and take less time to cool, reducing cycle time. The minimum wall thickness that can be used depends on the size and geometry of the part, structural requirements, and flow behavior of the resin. The wall thicknesses of an injection molded part generally range from 2 mm-4 mm (0.080"-0.160").

Thick sections take longer to cool than thin ones. During the cooling process, if walls are an inconsistent thickness, the thinner walls will cool first while the thick walls are still solidifying. As the thick section cools, it shrinks around the already solid thinner section. This causes warping, twisting or cracking to occur where the two sections meet. To avoid this problem, the present chair base embodiments have virtually completely uniform walls throughout the part. Where the walls are not of uniform thickness, the change in thickness is gradual. Advantageously, the wall thickness tapers described above not only reduce material usage, but also avoid defects during cooling. In the current designs, wall thickness variations do not exceed 10% in high mold shrinkage plastics. Thickness transitions are gradual; on the order of 3 to 1. This gradual transition avoids stress concentrations and abrupt cooling differences. Also, the fillets and chamfered comers described above minimize the dramatic change in pressures inside the mold.

Figure 10A:
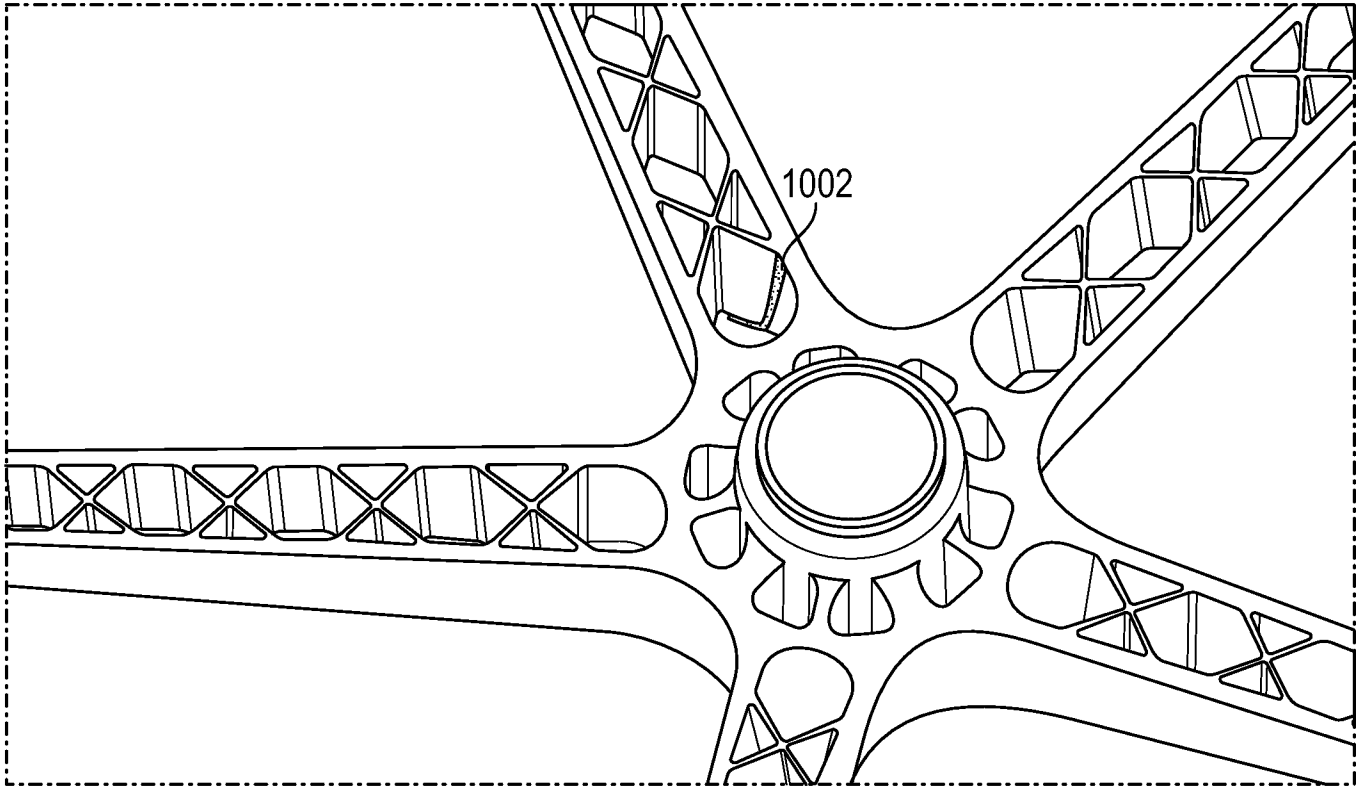
FIG. 10A illustrates a portion of the arm rib that is tapered via a variable radii at an intersection point between the arm rib and the side of the arm according to some embodiments.

In some embodiments, the present under structure provides less stress points and reduced material. FIG. 10A is an exemplary illustration of a portion of the arm rib that is tapered via a variable radii at an intersection zone 1002 between the arm rib and the side of the arm according to some embodiments. The taper can be wider (or a larger radius) at the bottom than that of the top.

Figure 10B:
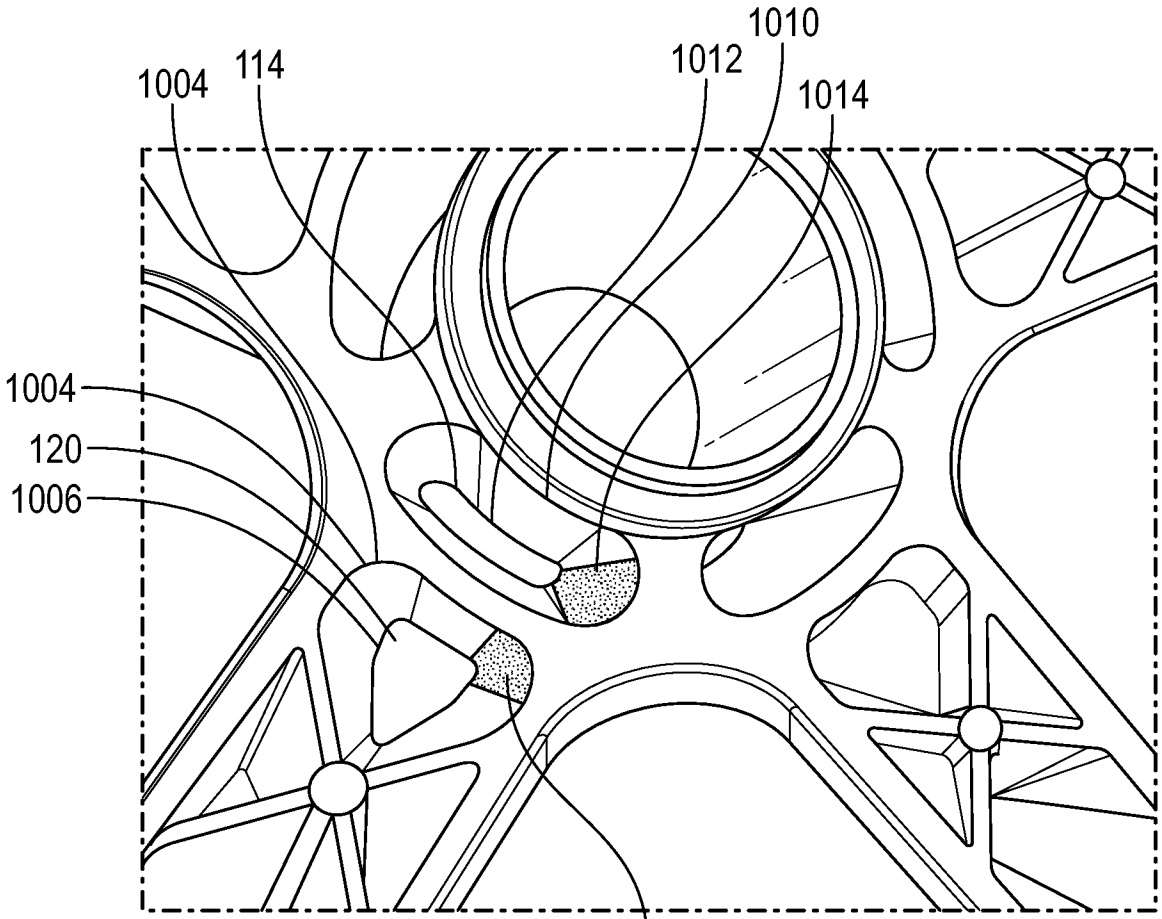
FIG. 10B illustrates tapering of the arm and hoop structure according to some embodiments.

FIG. 10B illustrates tapering of the arm and hoop structure according to some embodiments. The arm core 120 can include a bottom portion 1004 and a top portion 1006. As can be seen, the bottom portion 1004 of the arm core 120 is larger than the top portion 1006 of the arm core 120. This is due to the variable radii 1008 of the taper from the top portion 1006 to the bottom portion 1004.

FIG. 10B is an exemplary illustration of the hoop core 114 that can include a bottom portion 1010 and a top portion 1012 according to some embodiments. As can be seen, the bottom portion 1010 of the hoop core 114 is larger than the top portion 1012 of the hoop core 114. This is due to the variable radii 1014 of the taper from the top portion 1012 to the bottom portion 1010.

Figure 10C:
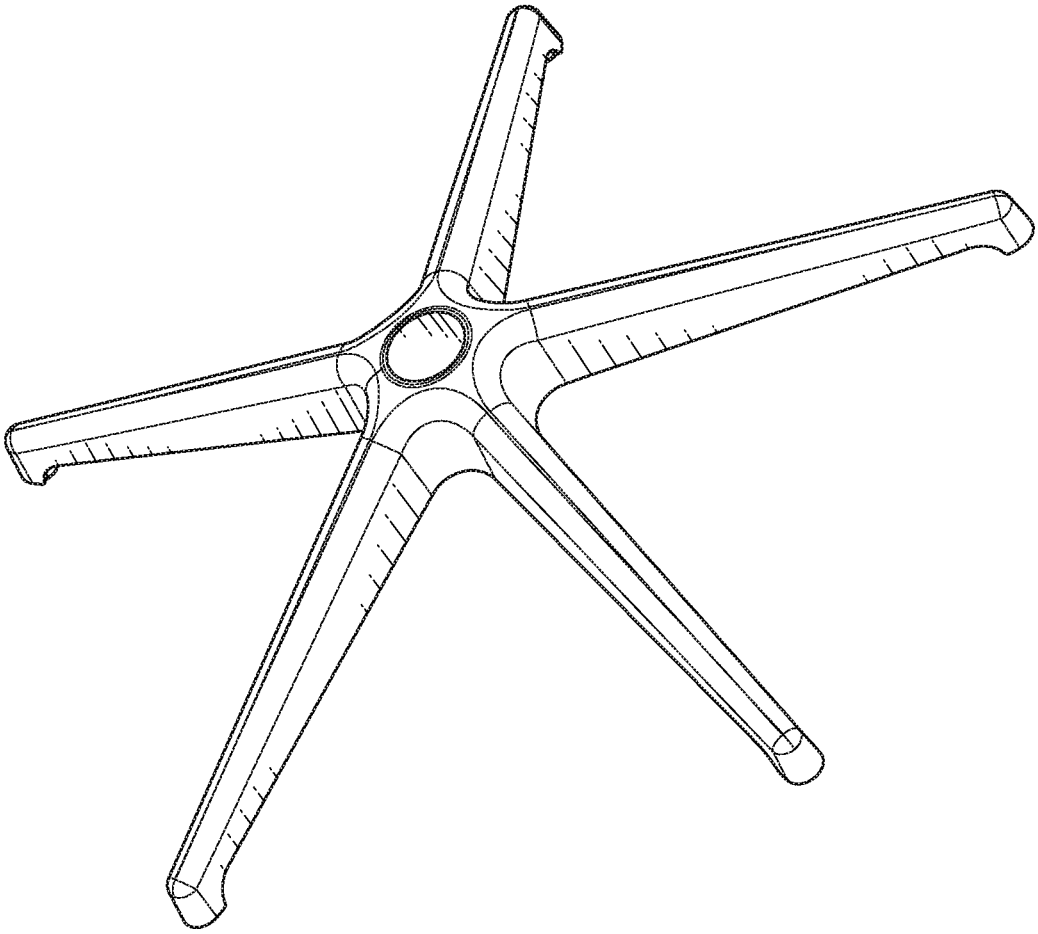
FIG. 10C illustrates a top view of the chair base according to some embodiments.

FIG. 10C illustrates a top view of the chair base according to some embodiments. As shown, the cores of the chair base, such as the arm core and hoop core, are located on the understructure of the chair base and not on the top of the chair base.

Figure 10D:
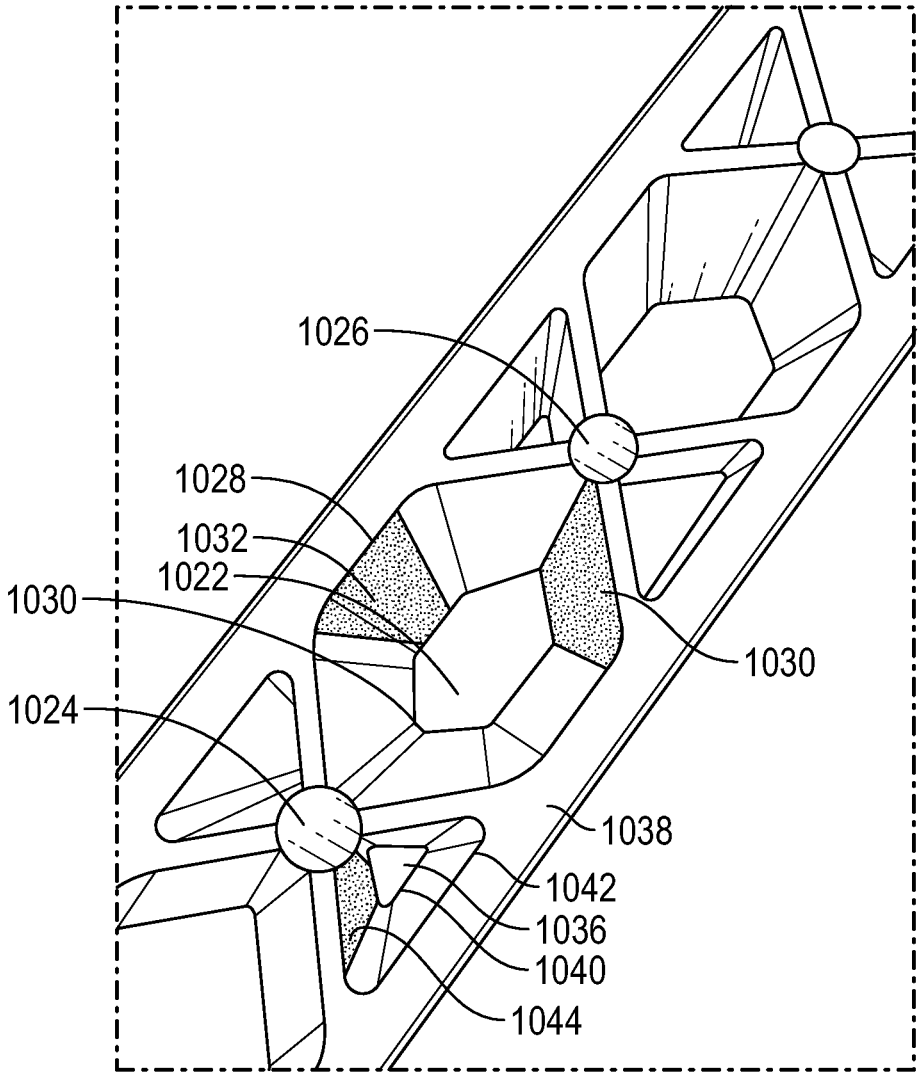
FIG. 10D illustrates tapering of arm-rib to arm-rib core according to some embodiments.

FIG. 10D illustrates tapering of arm-rib to arm-rib core according to some embodiments. The arm-rib to arm-rib core 1022 is between arm rib 1024 and arm rib 1026. The arm-rib to arm-rib core 1022 can include a bottom portion 1028 and a top portion 1030. As can be seen, the bottom portion 1028 of the arm-rib to arm-rib core 1022 is larger than the top portion 1030 of the arm-rib to arm-rib core 1022. This is due to the variable radii 1032, 1034 of the taper from the top portion 1030 to the bottom portion 1028.

FIG. 10D further illustrates tapering of arm-rib to side-wall core 1036 according to some embodiments. The arm-rib to side-wall core 1036 is between arm rib 1024 and a side wall 1038 of the arm. The arm-rib to side-wall core 1036 can include a bottom portion 1042 and a top portion 1040. As can be seen, the bottom portion 1042 of the arm-rib to side-wall core 1036 is larger than the top portion 1040 of the arm-rib to side-wall core 1036. This is due to the variable radii of the taper 1044 from the bottom portion 1042 and a top portion 1040.

Figure 10E:
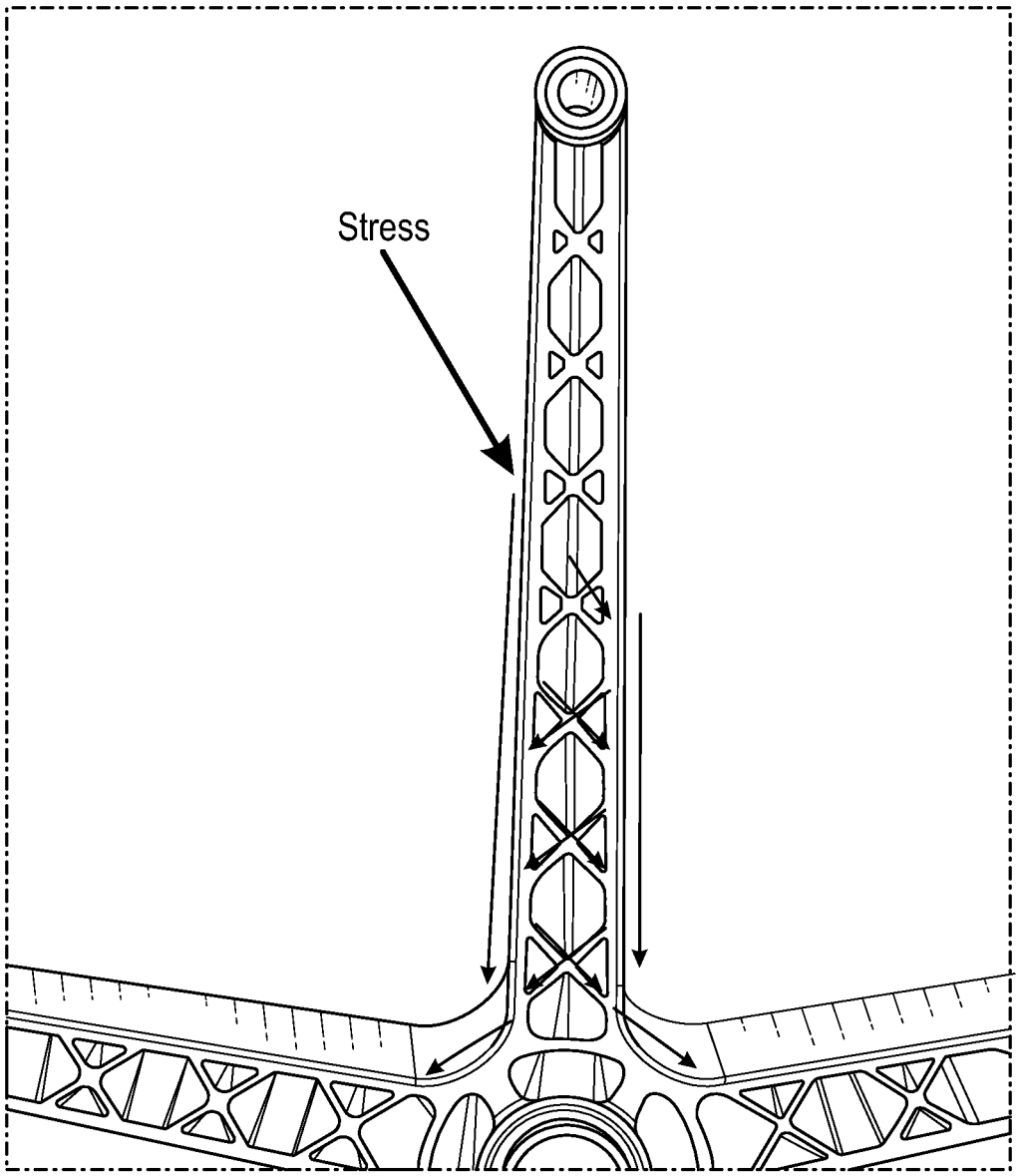
FIGS. 10E and 10F illustrates stress distribution of the chair base according to some embodiments.
Figure 10F:
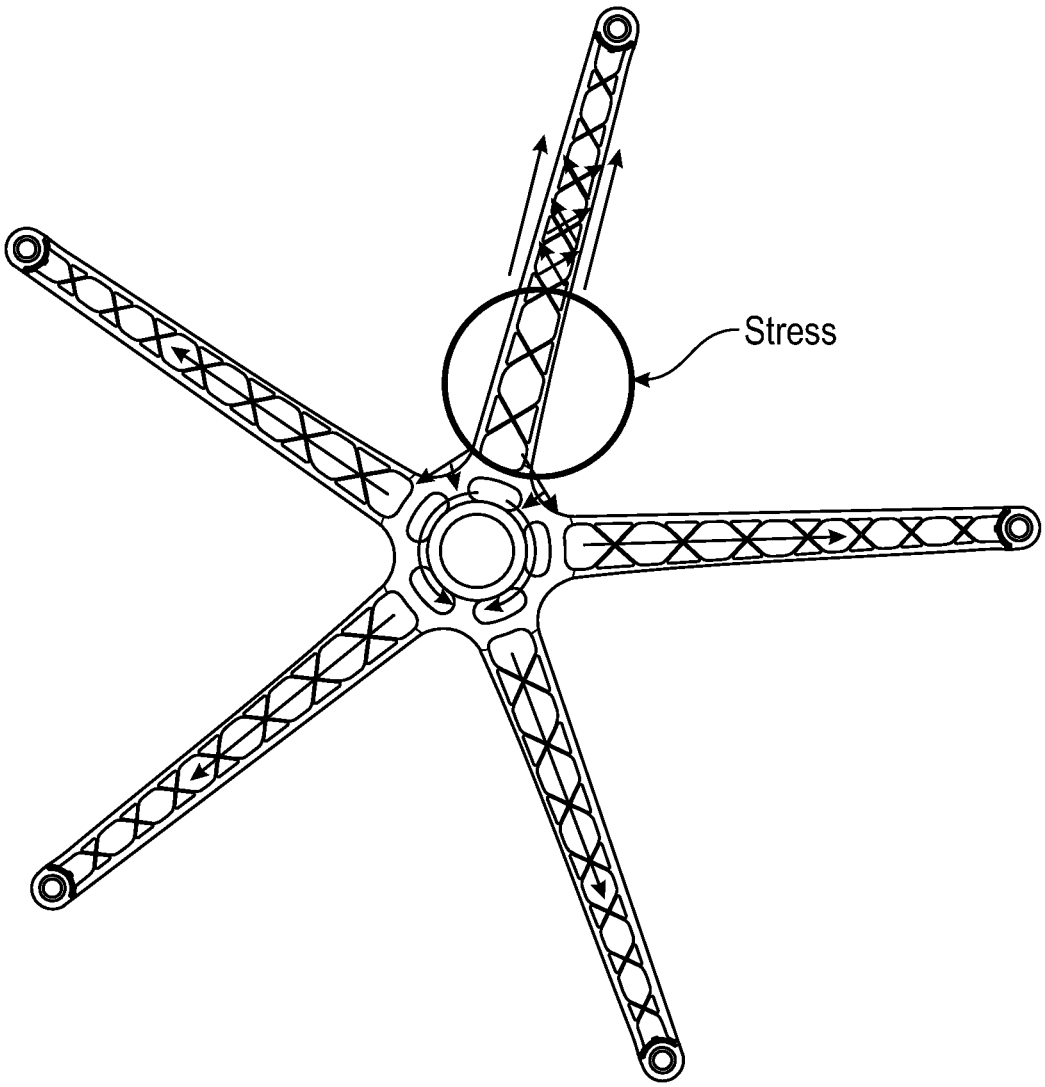

FIGS. 10E and 10F illustrates stress distribution of the chair base according to some embodiments. FIG. 10E illustrates stress distribution of stress coming from the side of an arm according to some embodiments. The stress can be distributed through the side-walls of the arm and throughout the ribs. FIG. 10F illustrates stress distribution of stress coming from the top of the chair base over an arm, according to some embodiments. The stress can be distributed throughout the side-walls of the arm and through the ribs, through the hoop structure including the hoop wall and hoop ribs, to the hub, and to the other arms. The features of the chair base can distribute stress in an effective manner while reducing material requirements.

Advantageously to some embodiments herein, there is less need for material while providing strengthening for weight at the bottom. The reduction of material allows for faster cooling, as the design allows for thinner walls. Moreover, the taper allows for ease of removal from the mold injection machine.

Test Results

Two types of testing have confirmed the advantages of the current chair base embodiments. Such tests are standard in the chair base industry for minimum safety and strength. In both cases, the chair base of the current embodiments exceed these minimum standards by a wide margin.

Figure 11:
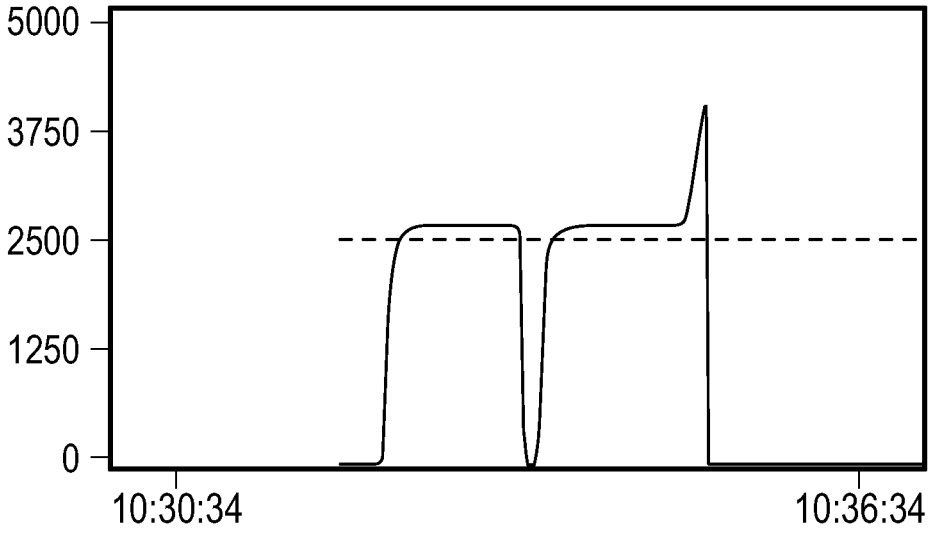
FIG. 11 is a graph illustrating the results of a strength test relating to the current chair base according to some embodiments.

In a first test, known as the static load test or BIFMA test, a chair base to be tested is supported at the end of each arm (without casters) and a vertical load is applied at the hub. The minimum standard for this test is 2500 psi, applied twice for a specified period of time. Failure should not occur. In one test, as shown in FIG. 11, one chair base of the current embodiments did not fail until 3995 psi was applied. In another test (not shown), failure did not occur until 4760 psi was reached.

Another test is known as the drop test. A chair base, with casters, is placed on a solid surface and a 300 lbs load is dropped from 6 inches on the hub. Failure should not occur. Because of the presence of casters, this test helps determine whether the chair base can withstand not only the vertical load but also the torsional forces applied to the arms.

Embodiments of the present disclosure have been tested and shown to not fail until the load was dropped from 12 inches.

Other Embodiments

Many variations and modifications may be made to the above-described embodiments, the elements of which are to be understood as being among other acceptable examples. All such modifications and variations are intended to be included herein within the scope of this disclosure. The foregoing description details certain embodiments. It will be appreciated, however, that no matter how detailed the foregoing appears in text, the systems and methods can be practiced in many ways. As is also stated above, it should be noted that the use of particular terminology when describing certain features or aspects of the systems and methods should not be taken to imply that the terminology is being re-defined herein to be restricted to including any specific characteristics of the features or aspects of the systems and methods with which that terminology is associated.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. Additionally, other implementations are within the scope of the following claims. In some cases, the actions recited in the claims can be performed in a different order and still achieve desirable results.

Conditional language, such as, among others, "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

The term "substantially" can mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. The term "substantially" can mean a 0.01%, 0.1%, 1%, 5%, or 10% difference.

The term "substantially" when used in conjunction with the term "real-time" forms a phrase that will be readily understood by a person of ordinary skill in the art. For example, it is readily understood that such language will include speeds in which no or little delay or waiting is discernible, or where such delay is sufficiently short so as not to be disruptive, irritating, or otherwise vexing to a user.

Conjunctive language such as the phrase "at least one of X, Y, and Z," or "at least one of X, Y, or Z," unless specifically stated otherwise, is to be understood with the context as used in general to convey that an item, term, etc. may be either X, Y, or Z, or a combination thereof. For example, the term "o r" is used in its inclusive sense (and not in its exclusive sense) so that when used, for example, to connect a list of elements, the term "or" means one, some, or all of the elements in the list. Thus, such conjunctive language is not generally intended to imply that certain embodiments require at least one of X, at least one of Y, and at least one of Z to each be present.

The term "a" as used herein should be given an inclusive rather than exclusive interpretation. For example, unless specifically noted, the term "a" should not be understood to mean "exactly one" or "one and only one"; instead, the term "a" means "one or more" or "at least one," whether used in the claims or elsewhere in the specification and regardless of uses of quantifiers such as "at least one," "one or more," or "a plurality" elsewhere in the claims or specification.

The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art.

The term "comprising" as used herein should be given an inclusive rather than exclusive interpretation. For example, a general purpose computer comprising one or more processors should not be interpreted as excluding other computer components, and may possibly include such components as memory, input/output devices, and/or network interfaces, among others.

While the above detailed description has shown, described, and pointed out novel features as applied to various embodiments, it may be understood that various omissions, substitutions, and changes in the form and details of the devices or processes illustrated may be made without departing from the spirit of the disclosure. As may be recognized, certain embodiments of the embodiments described herein may be embodied within a form that does not provide all of the features and benefits set forth herein, as some features may be used or practiced separately from others. The scope of certain embodiments disclosed herein is indicated by the appended claims rather than by the foregoing description. All changes which come within the meaning and range of equivalency of the claims are to be embraced within their scope.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A chair base comprising an understructure and a top, the chair base further comprising:

a central opening configured to receive a shaft of a swivel chair;

a plurality of arms each configured to accept a caster stem;

a hub surrounding the central opening and connected to the plurality of arms, the arms generally extending radially therefrom in an evenly spaced manner;

a hoop structure encircling the hub and comprising:

a plurality of hoop ribs spaced evenly around a circumference of the hub and supporting an outer wall thereof, each hoop rib extending along a radius aligned with a gap between two adjacent arms;

a hoop wall to which the hoop ribs connect and from which the plurality of arms extends; and a plurality of hoop cores comprising voids surrounded by adjacent hoop ribs, a portion of the hoop wall, and a portion of an outer wall of the hub, each hoop core centered with one of the plurality of arms, wherein the chair base consists of a number of hoop cores that is the same as a number of the plurality of arms.

2. The chair base of claim 1, wherein each arm includes at least one arm rib, wherein the arm rib is X-shaped.

3. The chair base of claim 2, wherein the arm rib is disposed on the understructure of the chair base and not on the top of the chair base, wherein the top of the chair base is facing the swivel chair.

4. The chair base of claim 2, wherein a portion of the arm rib is tapered via a variable radius at an intersection point between the arm rib and a side of the arm.

5. The chair base of claim 2, wherein each arm further includes at least one arm core comprising a void.

6. The chair base of claim 5, wherein the arm core is adjacent to the arm rib and the hoop structure.

7. The chair base of claim 5, wherein the arm core includes a triangle shape adjacent to the arm rib, and an extension shape from the hoop structure.

8. The chair base of claim 1, wherein the hoop rib is disposed on the understructure of the chair base and not on the top of the chair base.

9. The chair base of claim 1, wherein the hoop rib comprises a curved portion between two adjacent arms with a radius between 70 to 90 degrees of curvature.

10. The chair base of claim 1, wherein the hoop core is disposed on the understructure of the chair base and not on the top of the chair base.

11. The chair base of claim 1, wherein the hoop core is of generally oval shape.

12. The chair base of claim 1, wherein a width of the hoop core is substantially the same width of a corresponding arm.

13. A chair base comprising:

a plurality of arms each configured to accept a caster stem;

a hub surrounding a central opening and connected to the plurality of arms, the arms generally extending radially therefrom in an evenly spaced manner;

a hoop structure encircling the hub and comprising:

a plurality of hoop ribs spaced evenly around the circumference of the hub and supporting an outer wall thereof, each hoop rib extending along a radius aligned with a gap between two adjacent arms; and a plurality of hoop cores comprising voids surrounded by adjacent hoop ribs and a portion of an outer wall of the hub, each hoop core centered to align radially with one of the plurality of arms such that the chair base has the same number of hoop cores as a number of the plurality of arms.

14. The chair base of claim 13, wherein each arm includes at least one arm rib, wherein the arm rib is X-shaped.

15. The chair base of claim 14, wherein a portion of the arm rib is tapered via a variable radius at an intersection point between the arm rib and the side of the arm.

16. The chair base of claim 13, wherein the hoop rib is disposed on the understructure of the chair base and not on the top of the chair base.

17. The chair base of claim 13, wherein the hoop rib comprises a curved portion between two adjacent arms with a radius between 70 to 90 degrees of curvature.

18. The chair base of claim 13, wherein the hoop core is disposed on the understructure of the chair base and not on the top of the chair base.

19. The chair base of claim 13, wherein the hoop core is of generally oval shape.

20. The chair base of claim 13, wherein a width of the hoop core is substantially the same width of a corresponding arm.

* * * * *